US005194781A

United States Patent [19]

Konopka

[11] Patent Number: 5,194,781

[45] Date of Patent: Mar. 16, 1993

[54] CONTROL CIRCUIT

[75] Inventor: John G. Konopka, Barrington, Ill.

[73] Assignee: Motorola Lighting, Inc., Buffalo Grove, Ill.

[21] Appl. No.: 739,048

[22] Filed: Jul. 31, 1991

[51] Int. Cl.[5] ..... H05B 41/36; H01H 43/00

[52] U.S. Cl. ..... 315/291; 315/362; 307/140; 307/141

[58] Field of Search ..... 315/291, 362; 307/141, 307/140, 31, 157; 323/905

[56] References Cited

U.S. PATENT DOCUMENTS 3,940,660 2/1976 Edward ..... 307/141
4,345,233 8/1982 Matthies ..... 307/141 X
4,584,519 4/1986 Gruodis ..... 323/105 X
4,645,731 9/1987 Pierce ..... 307/141
4,668,877 5/1987 Kunen ..... 323/905 X

*Primary Examiner*—Eugene R. LaRoche
*Assistant Examiner*—Son Dinh
*Attorney, Agent, or Firm*—J. Ray Wood

[57] ABSTRACT

A control circuit (C) for controlling fluorescent lamps (102, 104 & 106) from a switch (S) having "open" and "closed" positions. The circuit senses whether the switch is (i) open, (ii) closed within less than approximately 0.5 seconds of last being opened, or (iii) closed for the first timne or after a time greater than approximately 0.5 seconds after last being opened, and produces one of three output signals respectively dependent thereon. The control circuit uses only a conventional two-position switch and conventional wiring and avoids the need for additional switches and additional wiring.

15 Claims, 1 Drawing Sheet

CONTROL CIRCUIT

FIELD OF THE INVENTION

This invention relates to a control circuit for use with a switch having first and second states.

BACKGROUND OF THE INVENTION

Such a control circuit is used in a wide variety of electrical applications. For example, such a control circuit is typically used with one or more lamps to control the illumination of the lamp or lamps from a switch having an "ON" and an "OFF" position. In such an application the control circuit senses when the switch is in the "ON" position and in response thereto produces a signal to enable the lamp or lamps to produce illumination, and the control circuit senses when the switch is in the "OFF" position and in response thereto produces a signal to disable the lamp or lamps from illuminating.

Thus, such a control circuit provides control of the lamps in one of two conditions: full illumination or no illumination, depending on whether the switch is instantaneously in the "ON" position or "OFF" position respectively.

In some applications it is desired to control the lamps or lamps in a third condition: for example, at a level of illumination intermediate between full illumination and no illumination. In such an application it has heretofore been necessary to use either an alternative switch having three positions (for example, an "OFF" position, an "intermediate-ON" position and a "full-ON" position) instead of the two-position switch described above, or to use a further two-position switch in addition to the two-position switch described above in order to provide an additional switch position for the intermediate illumination condition of the lamp or lamps. In either case, whether a substitute switch or an additional switch is used to provide the additional switch position for intermediate illumination, additional wiring is typically required to connect the additional switch position to the control circuit.

If it is desired to "retro-fit" lighting having abilities of both "full-ON" and "intermediate-ON" (often referred to as "dimmable" lighting) as well as "OFF" into an existing installation having just "ON" and "OFF" abilities as described above, this will thus require the installation of a different or an additional switch and also require the installation of additional wiring, which will significantly increase the cost of the retro-fitting exercise if the switch or switches are wall-mounted and the additional wiring needs to be hidden within the wall and/or ceiling, as is typically the case.

SUMMARY OF THE INVENTION

In accordance with the invention there is provided a control circuit for producing a first output signal, a second output signal or a third output signal in response to operation of a switch having a first state or a second state, the control circuit comprising: capacitance means arranged to become charged when the switch is in its second state and to become discharged when the switch is in its first state; sensing means for sensing whether the level of charge of the capacitance means is less than a predetermined level when the switch changes to its second state; and signal producing means for producing the first output signal when the switch is in its first state, the second output signal if the level of charge of the capacitance means is less than the predetermined level when the switch changes to its second state, and for producing the third output signal if the level of charge of the capacitance means is greater than the predetermined level when the switch changes to its second state.

In such a control circuit, by sensing not only whether the switch is in its first state or second state, but also by sensing when the switch changes to its second state within a predetermined time of having last been in its second state, the control circuit can provide first, second and third output signals without the need for additional switch positions or additional wiring.

Thus, for example, in a lighting application, the control circuit allows lighting having "full-ON", "intermediate-ON" and "OFF" capabilities to be retro-fitted into an existing installation having only "ON" and "OFF" capabilities, without requiring the complication and cost of installing replacement or additional switches or of installing additional wiring.

BRIEF DESCRIPTION OF THE DRAWINGS

One fluorescent lamp driver circuit incorporating a control circuit in accordance with the present invention will now be described, by way of example only, with reference to the accompanying drawings, in which.

DESCRIPTION OF THE PREFERRED EMBODIMENT

Figure 1:
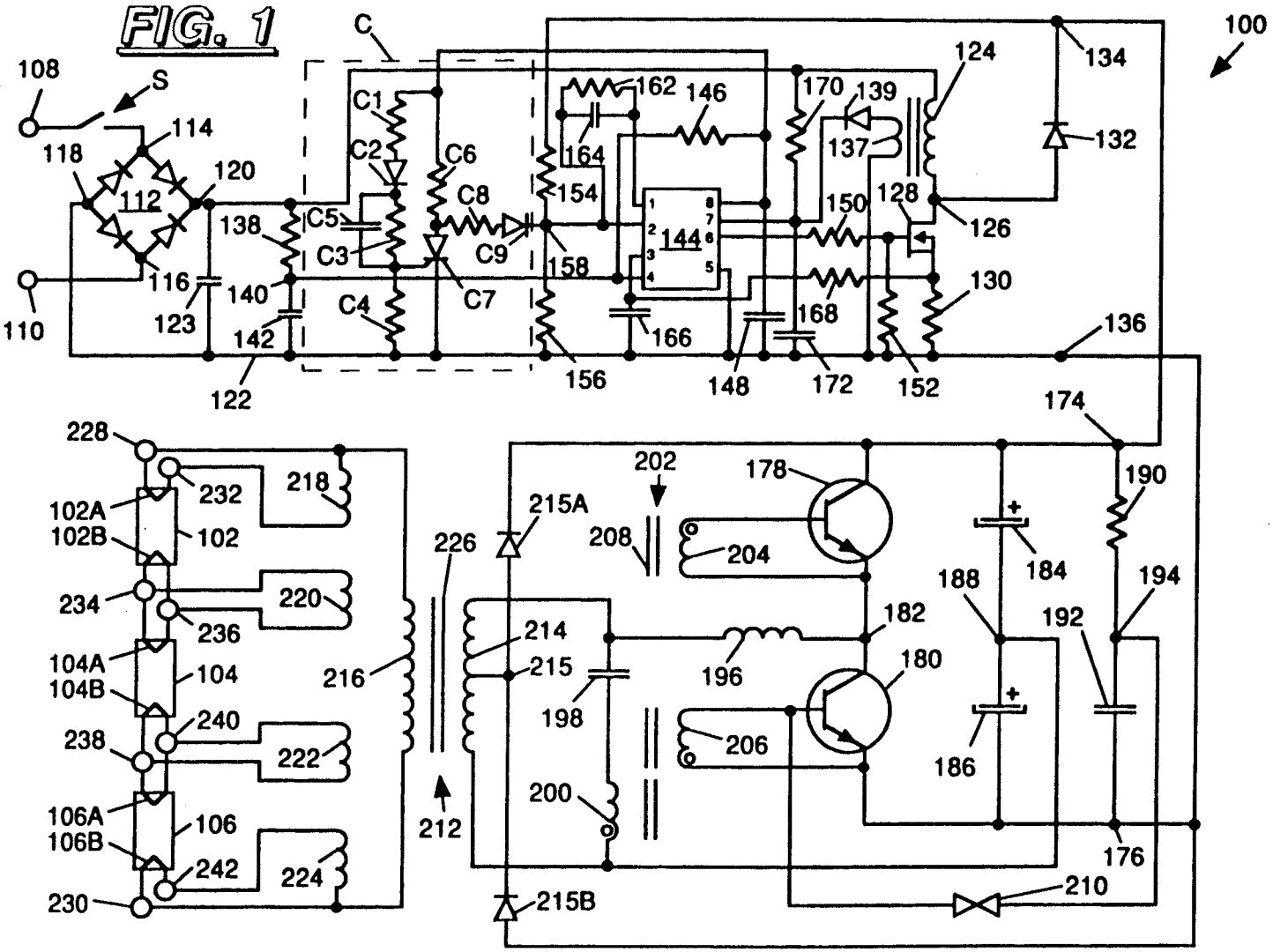
FIG. 1 shows a schematic circuit diagram of a driver circuit for driving three fluorescent lamps.

Referring now to FIG. 1, a circuit 100, for driving three fluorescent lamps 102, 104, 106, has two input terminals 108, 110 for receiving thereacross an AC supply voltage of approximately 277 V at a frequency of 60 Hz. A full-wave rectifying bridge circuit 112 has two input nodes 114, 116 and has two output nodes 118, 120. The input node 114 is connected to the input terminal 108 via a conventional two-pole, single throw switch S having an element (not shown) which is mechanically movable between "open" and "closed" positions. The input node 116 is connected directly to the input terminal 110. The output node 118 of the bridge 112 is connected to a ground voltage rail 122. A capacitor 123 (having a value of approximately 0.18μF) is connected between the output nodes 118 and 120 of the bridge circuit 112.

A cored inductor 124 (having an inductance of approximately 4.5 mH) has one end connected to the output node 120 of the bridge 112, and has its other end connected to a node 126. A field effect transistor (FET) 128 (of the type BUZ90) has its drain electrode connected to the node 126. The field effect transistor (FET) 128 has its source electrode connected, via a resistor 130 (having a value of approximately 1.6Ω), to the ground voltage rail 122. A diode 132 (of the type MUR160) has its anode connected to the node 126 and has its cathode connected to an output node 134. The ground voltage rail 22 is connected to an output node 136.

A resistor 138 (having a resistance of approximately 2MΩ) is connected between the output node 120 of the bridge 112 and a node 140. A capacitor 142 (having a capacitance of approximately 0.0039μF) is connected between the node 140 and the ground voltage rail 122. A current-mode control integrated circuit (IC) 144 (of the type AS3845, available from ASTEC Semiconductor) has its $R_T/C_T$ input (pin 4) connected to the node 140. The current mode control IC 144 has its $V_{REG}$ output (pin 8) connected, via a resistor 146 (having a resistance of approximately 10KΩ), to the node 140 and connected, via a capacitor 148 (having a capacitance of approximately 0.22μF) to the ground voltage rail 122. The current mode control IC 144 has its control signal output (pin 6) connected, via a resistor 150 (having a resistance of approximately 20Ω), to the gate electrode of the FET 128. The gate electrode of the FET 128 is also connected, via a resistor 152 (having a resistance of approximately 22KΩ), to the ground voltage rail 122.

Two resistors 154, 156 (having respective resistances of approximately 974KΩ and 5.36KΩ) are connected in series, via an intermediate node 158, between the output terminal 134 and the ground voltage rail 122. The current mode control IC 144 has its $V_{FB}$ input (pin 2) connected to the node 158. The current mode control IC 144 has its COMP output (pin 1) connected to its $V_{FB}$ input (pin 2) via a parallel-connected resistor 162 (having a resistance of approximately 1.5MΩ) and capacitor 164 (having a capacitance of approximately 0.22μF). The current mode control IC 144 has its current sense input (pin 3) connected to the ground voltage rail 122 via a capacitor 166 (having a capacitance of approximately 470pF) and to the source electrode of the FET 128 via a resistor 168 (having a resistance of approximately 1KΩ).

The current mode control IC 144 has its $V_{CC}$ input (pin 7) connected to the bridge rectifier output node 120 via a resistor 170 (having a resistance of approximately 240KΩ) and connected to the ground voltage rail 122 via a capacitor 172 (having a capacitance of approximately 100μF). The current mode control IC 144 has its GND input (pin 5) connected to the ground voltage rail 122. A winding 137, wound on the same core as the inductor 124, has one end connected to the ground voltage rail 122 and has its other end connected via a diode 139 to the $V_{CC}$ input (pin 7) of the IC 144.

The driver circuit 100 also includes a control circuit C. The control circuit C has, connected in a series chain, a resistor C1 (having a value of approximately 3.3KΩ), a diode C2, a resistor C3 (having a value of approximately 10MΩ), and a resistor C4 connected to the ground voltage rail 122. The diode C2 has its anode connected to the resistor Cl and has its cathode connected to the resistor C3. A capacitor C5 (having a value of approximately 0.01μF) is connected in parallel with the resistor C3 between the cathode of the diode C2 and the resistor C4.

In parallel with the series chain formed by the components C1, C2, C3 and C4, there is connected another series chain formed by a resistor C6 (having a value of approximately 1KΩ) and a silicon controlled rectifier (or thyristor) C7 (of the type 2N5060). The thyristor C7 has its anode connected to the resistor C6 and has its cathode connected to the ground voltage rail 122; the thyristor has its gate electrode connected to the junction of the resistors C3 and C4.

The anode of the thyristor C7 is connected, via a series-connected resistor C8 (having a value of approximately 47KΩ) and diode C9, to the node 158. The junction of the resistors C1 and C6 is connected to the $V_{REG}$ output (pin 8) of the current mode control IC 144.

The power supply output terminals 134 and 136 are connected to input nodes 174 and 176 of a half-bridge inverter formed by two npn bipolar transistor 178 and 180 (each of the type BUL45). The transistor 178 has its collector electrode connected to the input node 174, and has its emitter electrode connected to an output node 182 of the inverter. The transistor 180 has its collector electrode connected to the node 182, and has its emitter electrode connected to the input node 176. Two electrolytic capacitors 184 and 186 (each having a value of approximately 47μF) are connected in series between the inverter input nodes 174 and 176 via an intermediate node 188. For reasons which will be explained below, a resistor 190 (having a value of approximately 1MΩ) and a capacitor 192 (having a value of approximately 0.1μF) are connected in series between the inverter input nodes 174 and 176 via an intermediate node 192.

The inverter output node 182 is connected to a series-resonant tank circuit formed by an inductor 196 (having a value of approximately 5.35 mH) and a capacitor 198 (having a value of approximately 10nF). The inductor 196 and the capacitor 198 are connected in series, via a primary winding 200 of a base-coupling transformer 202 which will be described more fully below, between the inverter output node 182 and the node 188. The base-coupling transformer 202 includes the primary winding 200 (having approximately 8 turns) and two secondary windings 204 and 206 (each having approximately 24 turns) wound on the same core 208. The secondary windings 204 and 206 are connected with opposite polarities between the base and emitter electrodes of the inverter transistors 178 and 180 respectively. The base electrode of the transistor 180 is connected via a diac 210 (having a voltage breakdown of approximately 32 V) to the node 194.

An output-coupling transformer 212 has its primary winding 214 connected in series with the inductor 196 and in parallel with the capacitor 198 and the primary winding 200 of the base-coupling transformer 202 to conduct output current from the tank circuit formed by the series-resonant inductor 196 and capacitor 198. The primary winding 214 of the transformer 212 is center-tapped at a node 215, which is coupled to the inverter input nodes 174 and 176 via diodes 215A and 215B respectively.

The output-coupling transformer 212 includes the primary winding 214 (having approximately 70 turns), a principal secondary winding 216 (having approximately 210 turns) and four filament-heating secondary windings 218, 220, 222 and 224 (each having approximately 3 turns) wound on the same core 226. The principal secondary winding 216 is connected across output terminals 228 and 230, between which the three fluorescent lamps 102, 104 and 106 are connected in series. The lamps 102, 104 and 106 each have a pair of filaments 102A & 102B, 104A & 104B and 106A & 106B respectively located at opposite ends thereof. The filament-heating secondary winding 218 is connected across the output terminal 228 and an output terminal 232, between which the filament 102A of the lamp 102 is connected. The filament-heating secondary winding 220 is connected across output terminals 234 and 236, between which both the filament 102B of the lamp 102 and the filament 104A of the lamp 104 are connected in parallel. The filament-heating secondary winding 222 is connected across output terminals 238 and 240, between which both the filament 104B of the lamp 104 and the filament 106A of the lamp 106 are connected in parallel. The filament-heating secondary winding 224 is connected across the output terminal 230 and an output terminal 242, between which the filament 106B of the lamp 106 is connected.

The integrated circuit 144 and its associated components form a voltage-boost circuit which produces, when activated, a boosted output voltage between the output terminals 134 and 136. The detailed operation of such a voltage-boost circuit is described more fully in, for example, U.S. patent application No. 07/665,830, which is assigned to the same assignee as the present application, and the disclosure of which is hereby incorporated herein by reference.

The transistors 178 and 180, the inductor 196, the capacitor 198 and their associated components form a self-oscillating inverter circuit which produces, when activated, a high-frequency (e.g. 40 KHz) AC voltage across the primary winding 214 of the output-coupling transformer 212. The voltages induced in the secondary windings 218, 220, 222 and 224 216 of the output-coupling transformer serve to heat the lamp filaments 102A & 102B, 104A & 104B and 106A & 106B and the voltage induced in the secondary winding 216 of the output-coupling transformer serves to drive current through the lamps 102, 104 and 106. The detailed operation of such a self-oscillating inverter circuit is described more fully in, for example, U.S. patent application No. 07/705,856, which is assigned to the same assignee as the present application, and the disclosure of which is hereby incorporated herein by reference.

In operation of the circuit of FIG. 1, with the switch S closed and with a voltage of 277 V, 60 Hz applied across the input terminals 108 and 110, the bridge 112 produces between the node 120 and the ground voltage rail 122 a unipolar, full-wave rectified, DC voltage having a frequency of 120 Hz.

When the circuit is first powered-up, the activation of the voltage-boost IC 144 is controlled, for reasons which will be explained below, by the resistive-capacitive divider 170, 172 connected between the output nodes 118 and 120 of the bridge circuit 112. The component values in the preferred embodiment of the circuit of FIG. 1 are chosen to produce a delay of approximately 0.7 seconds between initial power-up of the circuit and activation of the voltage-boost IC 144. Similarly, when the circuit is first powered-up, the activation of the self-oscillating inverter is controlled by the resistive-capacitive divider 190, 192 connected between the output terminals 134 and 136 of the voltage-boost circuit formed by the IC 144 and its associated components. The component values in the preferred embodiment of the circuit of FIG. 1 are chosen to produce a delay of approximately 40 milliseconds between initial power-up of the circuit and activation of the self-oscillating inverter.

The circuit of FIG. 1 is so arranged that, with the self-oscillating inverter activated but before activation of the voltage-boost IC 144, an unboosted voltage of approximately 390 V appears across the output terminals 134 and 136, and the voltage induced in the secondary windings 218, 220, 222 and 224 is sufficient to produce significant heating of the filaments 102A & 102B, 104A & 104B and 106A & 106B, but the voltage induced in the secondary winding 216 is insufficient to cause the lamps to strike. However, after activation of the voltage-boost IC 144, a boosted voltage of approximately 458 V appears across the output terminals 134 and 136 and the voltage induced in the secondary windings 118, 120, 122 and 124 continues to heat the filaments and the voltage induced in the secondary winding 216 is sufficient to cause the lamps to strike.

Thus, by arranging that (i) the unboosted voltage across the output terminals 134 and 136 causes heating of the filaments 102A & 102B, 104A & 104B and 106A & 106B but no striking of the lamps 102, 104 and 106, (ii) there is a delay of approximately $\frac{1}{3}$ seconds ($0.66=0.7-0.04$) seconds between activation of the self-oscillating inverter and activation of the voltage-boost circuit; and (iii) the boosted voltage across the output terminals 134 and 136 causes striking of the lamps 102, 104 and 106 as well as continued heating of the filaments 102A & 102B, 104A & 104B and 106A & 106B, the circuit of FIG. 1 simply and effectively produces pre-heating of the lamp filaments before the lamps are caused to strike.

Such differentially delayed inverter/voltage-boost start-up is described in greater detail in U.S. patent application No. 07/705,865, which is assigned to the same assignee as the present application, and the disclosure of which is hereby incorporated herein by reference.

The control circuit C controls operation of the drive circuit 100 in dependence on the operation of the switch S as follows. Before the switch S is first closed, the capacitor C5 of the control circuit C is uncharged. When the switch S is first closed, and power is first applied to the circuit 100, the self-oscillating inverter is activated after a delay of approximately 40 milliseconds (beginning pre-heating of the lamp filaments as described above) and the voltage-boost IC 144 is activated after a delay of approximately 0.7 seconds (causing striking of the lamps as also described above).

Immediately the voltage-boost IC 144 becomes activated, it produces at its $V_{REG}$ output (pin 8) a regulated voltage of approximately 5 V. This regulated voltage output is applied to the two parallel chains of series connected components C1, C2, C3 & C4 and C6 & C7 in the control circuit C. Thus, the diode C2 becomes forward biased and causes current to flow through the resistor C1 to charge the capacitor C5. As the capacitor C5 begins rapidly to charge, the peak charging current which flows through the capacitor develops across the resistor C4 a voltage which is sufficient to latch the thyristor C7 in its conducting state. With the thyristor C7 latched in its conducting state, the anode of the thyristor is pulled to a voltage of approximately 1V. With the voltage-boost IC 144 activated, a voltage of 2.5 V is produced at the node 158, causing the diode C9 to be reverse biased and effectively causing the control circuit C to be disconnected from the rest of the driver circuit 100. In this condition, as described above the voltage produced between the output nodes 134 and 136 is approximately 458 V.

When the switch S is opened, the voltage-boost IC 144 becomes inactivated after a delay of approximately 0.25 seconds which is determined by the values of the components in the resistive-capacitive divider 170, 172. Immediately the voltage-boost IC 144 becomes inactivated, the voltage produced at the $V_{REG}$ output (pin 8) of the IC 144 falls to zero volts. This fall in $V_{REG}$ output voltage causes the thyristor C7 to become non-conducting and causes the diode C2 to become reverse biased, preventing the charge on the capacitor C5 from discharging through the resistor C1. When the diode C2 becomes reverse biased, the charge on the capacitor C5 begins discharging through the resistor C3.

If the switch S is re-closed after an interval of more than approximately 0.5 seconds after being opened, the charge on the capacitor C5 has reduced to a sufficiently low level that when the voltage-boost IC 144 is re-activated, the peak charging current which flows through the capacitor C5 is sufficiently high to produce a large enough voltage across the resistor C4 to cause the thyristor C7 to latch in its conducting state. With the thyristor C7 latched in its conducting state, the diode C9 becomes reverse biased and the voltage at the node 158 becomes approximately 2.5 V as described above. Thus, if the switch S is re-closed more than approximately 0.5 seconds after being opened, the control circuit C responds in the same way as at initial closing of the switch and causes approximately 458 V to be produced between the output nodes 134 and 136.

However, if (after the switch S has been closed and the capacitor C5 has become fully charged) the switch is opened and then closed within approximately 0.5 seconds, the capacitor C5 has discharged by a lesser amount than in the immediately preceding paragraph. Now, when the voltage-boost IC becomes re-activated and the capacitor C5 begins to re-charge, the peak charging current which flows through the capacitor C5 is insufficient to produce a large enough voltage across the resistor C4 to cause the thyristor C7 to latch in its conducting state. Thus although the capacitor C5 becomes fully charged, the thyristor C7 will not re-latch and will remain in its non-conducting state. With the thyristor C7 in its non-conducting state, the diode C9 will become forward biased, causing current to flow through the resistors C6 and C8 to the node 158, and so increasing the voltage at the node 158 above 2.5 V. The increased voltage at the node 158 causes the voltage-boost IC 144 to produce a reduced voltage of approximately 400 V between the output nodes 134 and 136. This reduced boosted voltage of 400 V is still sufficient to cause striking of the lamps 102, 104 & 106, but causes the lamps to produce less light compared with a full boosted voltage of approximately 458 V as described above. In practice, in the preferred embodiment of the circuit of FIG. 1, such a reduction in the boosted voltage level produces a reduction in light energy output of the order of 50%. Such a reduced light output is commonly referred to as "dimmed".

If, from this "dimmed" condition, the switch S is opened and re-closed the control circuit C will act in exactly the same way, as described above, as if the lamps had been operating at full light output when the switch was opened, since the amount of charge on the capacitor C5 at the moment the switch S is opened is the same whether the lamps are being operated at full light output or dimmed light output.

Thus, in dependence on whether the switch S is (i) open, (ii) closed within less than approximately 0.5 seconds of last being opened, or (iii) closed for the first time or after a time greater than approximately 0.5 seconds after last being opened, the control circuit C produces at the node 158 a voltage which is respectively (i) zero, (ii) greater than approximately 2.5 V, or (iii) approximately 2.5 V. In response to these voltages at the node 158, the driver circuit 100 produces respectively (i) no light output ("OFF" state), (ii) 50% light output ("intermediate-ON" state), or (iii) full light output ("full-ON" state).

Thus, the control circuit C in the driver circuit 100 controls the lamps 102, 104 & 106 in one of three states ("OFF", "intermediate-ON" or "full-ON") in dependence on the operation of the conventional two-position switch S.

It will be understood that the interval of approximately 0.5 seconds for determining whether the driver circuit 100 should operate the lamps "intermediate-ON" or "full-ON" is determined principally by the values of the capacitor C5 and the resistor C3, and that these values may be altered to produce an interval different from approximately 0.5 seconds as desired.

In a lighting installation where the switches are typically wall-mounted and wires which extend from the switches are hidden in walls and and/or ceilings, the cost of installing replacement or additional switches and additional wiring into an existing installation in order to provide control of a third state of operation of the light can be considerable. It will be appreciated that the driver circuit 100 incorporating the control circuit C described above can be used with any existing conventional two-position to switch fluorescent lamps between three different states, without requiring the complication and cost of installing replacement or additional switches or additional wiring.

It will be appreciated that although the invention has been described above in relation to a conventional switch having an element mechanically movable between "open" and "closed" positions, the invention is not limited to switches having mechanically movable elements, and may be used equally well with other switches (for example, electronic touch-sensitive switches) having no mechanically moving parts.

It will be appreciated that the particular time intervals used in the above described control circuit, and the particular voltage levels may be varied as desired to suit different types of fluorescent or other gas discharge lamps as desired.

It will also be appreciated that although the invention has been described above in relation to a control circuit used to control lighting units, the invention is not limited to the control of lighting units and may be used equally well to control any electric circuit or device between three conditions in dependence on the operation of a switch having two states.

It will be appreciated that various other modifications or alternatives to the above described embodiment will be apparent to a person skilled in the art without departing from the inventive concept of sensing whether a switch is in a first state, a second state or has changed to the second state within a predetermined time of last having been in the second state in order to produce respectively a first, second or third output signal.

I claim:

1. A control circuit for producing a first output signal, a second output signal or a third output signal in response to operation of a switch having a first state or a second state, the control circuit comprising:

capacitance means arranged to become charged when the switch is in its second state and to become discharged when the switch is int its first state;

sensing means for sensing whether the level of charge of the capacitance means is less than a predetermined level when the switch changes to its second state; and signal producing means for producing the first output signal when the switch is in its first state, the second output signal if the level of charge of the capacitance means is less than the predetermined level when the switch changes to its second state and for producing the third output signal if the level of charge of the capacitance means is greater than the predetermined level when the switch changes to its second state.

2. A control circuit according to claim 1 wherein the sensing means comprises:

silicon controlled rectifier means arranged so that its state of conduction is dependent on whether the level of charge of the capacitance means is less than a predetermined level when the switch changes to its second state.

3. A control circuit according to claim 2 wherein the silicon controlled rectifier means is arranged to be rendered conductive if the level of charge of the capacitance means is less than the predetermined level when the switch changes to its second state and to be rendered non-conductive if the level of charge of the capacitance means is greater than the predetermined level when the switch changes to its second state.

4. A control circuit according to claim 1 wherein the predetermined time is substantially 0.5 second.

5. A driver circuit for driving a device in response to operation of a switch having a first state or a second state, the driver circuit comprising:

capacitance means arranged to become charged when the switch is in its second state and to become discharged when the switch is in its first state; and sensing means for sensing whether the level of charge of the capacitance means is less than a predetermined level when the switch changes to its second state; and driver means arranged to produce the first output signal and to drive the device in a first condition in response thereto when the switch is in its first state, to produce the second output signal and to drive the device in a second condition in response thereto if the level of charge of the capacitance means is less than the predetermined level when the switch changes to its second state, and to produce the third output signal and to drive the device in a third condition in response thereto if the level of charge of the capacitance means is greater than the predetermined level when the switch changes to its second state.

6. A driver circuit according to claim 5 wherein the sensing means comprises:

silicon controlled rectifier means arranged so that its state of conduction is dependent on whether the level of charge of the capacitance means is less than a predetermined level when the switch changes to its second state, the driver means being responsive to the state of conduction of the silicon controlled rectifier means.

7. A driver circuit according to claim 6 wherein the silicon controlled rectifier means is arranged to be rendered conductive if the level of charge of the capacitance mans is less than the predetermined level when the switch changes to its second state and to be rendered non-conductive if the level of charge of the capacitance mans is greater than the predetermined level when the switch changes to its second state.

8. A driver circuit according to claim 5 wherein the predetermined time is substantially 0.5 seconds, 9. A driver circuit according to claim 5 wherein the driver means comprises current mode control means having a control input connected to receive the first, second and third output signals and having an output connected for controlling the device in dependence on the received signal.

10. A driver circuit according to claim 5 for driving a gas discharge lamp load.

11. A control circuit for use with a switch having a first state or a second state, the control circuit comprising:

an input node for coupling to the switch to receive a first input signal when the switch is in its first state and a second input signal when the switch is in its second state;

capacitance means coupled to the input node to become charged in response to the first input signal being received and discharged in response to the second input signal being received; and silicon controlled rectifier means connected to the capacitance means so that the state of conduction of the silicon controlled rectifier means is dependent on whether the level of charge of the capacitance means is less than a predetermined level when the first input signal is received.

12. A control circuit according to claim 11 wherein: the capacitance means comprises:

a capacitor having a first electrode coupled to the input node and a second electrode coupled to a reference node; and a first resistor connected in parallel with the capacitor, and the silicon controlled rectifier means comprises:

a thyristor having an anode and a cathode coupled between the input node and the reference node in parallel with the capacitor, and having a gate electrode coupled to one of the electrodes of the capacitor.

13. A control circuit according to claim 12 wherein the capacitance means further comprises:

a first diode coupled between the input node and the firsts electrode of the capacitor; and a second resistor coupled between the second electrode of the capacitor and the reference node, and the silicon controlled rectifier means further comprises:

a second diode coupled between an output node of the control circuit and one of the anode and cathode of the thyristor.

14. A control circuit according to claim 11 wherein the capacitor has a value of substantially 0.1$\mu$F.

15. A control circuit according to claim 11 wherein the first resistor has a value of substantially 10M$\Omega$.

* * * * *

UNITED STATES PATENT AND TRADEMARK OFFICE

CERTIFICATE OF CORRECTION

PATENT NO. : 5,194,781

DATED : March 16, 1993

INVENTOR(S) : John G. Konopka

It is certified that error appears in the above-identified patent and that said Letters Patent is hereby corrected as shown below:

On the Title page, item [57]

In the Abstract:

Line 6, "timne" should be --time--.

At column 8, line 52, "int" should be --in--.

At column 9, line 15, "second" should be --seconds--.

At column 9, line 53, "mans" should be --means--.

At column 9, line 56, "mans" should be --means--.

At column 10, line 2, "seconds," should be --seconds.--.

At column 10, line 44, "firsts" should be --first--.

Signed and Sealed this

Thirtieth Day of November, 1993

Bruce Lehman

*Attest:*

BRUCE LEHMAN

*Attesting Officer*

*Commissioner of Patents and Trademarks*